US008152284B2

(12) United States Patent
Park et al.

(10) Patent No.: US 8,152,284 B2
(45) Date of Patent: Apr. 10, 2012

(54) INKJET HEAD AND INKJET HEAD ASSEMBLY HAVING THE SAME

(75) Inventors: Yoon Sok Park, Gyunggi-do (KR); Jae Woo Joung, Gyunggi-do (KR); Jun Young Kim, Gyunggi-do (KR); Jae Chan Park, Gyunggi-do (KR); Ju Hwan Yang, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 304 days.

(21) Appl. No.: 12/654,533

(22) Filed: Dec. 22, 2009

(65) Prior Publication Data

US 2011/0057995 A1 Mar. 10, 2011

(30) Foreign Application Priority Data

Sep. 10, 2009 (KR) ..... 10-2009-0085357

(51) Int. Cl.
*B41J 2/045* (2006.01)

(52) U.S. Cl. ..... 347/71

(58) Field of Classification Search ..... None
See application file for complete search history.

(56) References Cited

U.S. PATENT DOCUMENTS

2008/0129799 A1 * 6/2008 Lee et al. ..... 347/71

* cited by examiner

*Primary Examiner* — Matthew Luu
*Assistant Examiner* — Lisa M Solomon

(57) ABSTRACT

There is provided an inkjet head and an inkjet head assembly having the same. The inkjet head includes an inkjet head plate having a plurality of nozzles ejecting ink provided therein; pressure chambers storing ink drawn in from both outer ends of the inkjet head plate in a width direction thereof and facing each other in a direction inwards of the width direction; piezoelectric elements supplying the pressure champers with driving force allowing ink to be ejected through the nozzles connected to the pressure chambers and disposed on the pressure chambers having membranes interposed therebetween; a pressure adjusting channel connecting the pressure chambers to adjust a pressure of ink ejected through the nozzles.

10 Claims, 6 Drawing Sheets

INKJET HEAD AND INKJET HEAD ASSEMBLY HAVING THE SAME

CROSS-REFERENCE TO RELATED APPLICATIONS

This application claims the priority of Korean Patent Application No. 10-2009-0085357 filed on Sep. 10, 2009, in the Korean Intellectual Property Office, the disclosure of which is incorporated herein by reference.

BACKGROUND OF THE INVENTION

1. Field of the Invention

The present invention relates to an inkjet head and an inkjet head assembly having the same, and more particularly, to an inkjet head and an inkjet head assembly having the same allowing for uniform pressure in ink ejected through nozzles by the use of a pressure adjusting channel connecting pressure chambers while the pressure chambers are arranged to face each other and the nozzles connected to the pressure chambers are arranged in rows between the pressure chambers.

2. Description of the Related Art

In general, an inkjet head converts electrical signals into physical impulses so that ink droplets are ejected through small nozzles. Particularly, an inkjet head assembly includes an inkjet head having a nozzle plate and a cartridge supplying ink to the inkjet head.

In recent years, a piezoelectric inkjet head has been used in industrial inkjet printers. For example, it is used to directly form a circuit pattern by spraying ink prepared by melting metals such as gold or silver onto a printed circuit board (PCB). A piezoelectric inkjet head is also used for creating industrial graphics, or for the manufacturing of a liquid crystal display (LCD), an organic light emitting diode (OLED), and a solar cell.

Inside an inkjet head of an industrial inkjet printer, there are provided an inlet and an outlet through which ink is introduced and ejected in a cartridge, a reservoir storing the ink being introduced, and chambers transferring the driving force of an actuator so as to move the ink stored in the reservoir toward nozzles.

In the case that an inkjet head according to the related art has chambers facing each other and nozzles respectively connected with the chambers, there are variations in the speed and size of ink droplets ejected through each nozzle. Accordingly, there is a need for research so as to remove such variations.

SUMMARY OF THE INVENTION

An aspect of the present invention provides an inkjet head and an inkjet head assembly having the same allowing for uniform pressure in ink ejected through nozzles by the use of a pressure adjusting channel connecting pressure chambers while the pressure chambers are arranged to face each other and the nozzles connected to the pressure chambers are arranged in rows between the pressure chambers.

According to an aspect of the present invention, there is provided an inkjet head assembly, the inkjet head assembly including: an inkjet head having a plurality of nozzles ejecting ink provided therein; pressure chambers storing ink drawn in from both outer ends of the inkjet head in a width direction thereof and facing each other in a direction inwards of the width direction; piezoelectric elements supplying the pressure champers with driving force allowing ink to be ejected through the nozzles connected to the pressure chambers and disposed on the pressure chambers having membranes interposed therebetween; a pressure adjusting channel connecting the pressure chambers to adjust a pressure of ink ejected through the nozzles; and an ink cartridge combined with the inkjet head and supplying ink to the inkjet head.

The nozzles may be arranged in rows between the pressure chambers in a length direction of the inkjet head.

The inkjet head assembly may further include dampers connecting the pressure chambers with the nozzles.

The dampers may be extended from the pressure chambers and slantly disposed in a length direction of the inkjet head.

According to another aspect of the present invention, there is provided an inkjet head assembly, the inkjet head assembly including: an inkjet head having a plurality of nozzles ejecting ink provided therein; pressure chambers storing ink drawn in from both outer ends of the inkjet head in a width direction thereof and facing each other in a direction inwards of the width direction; piezoelectric elements supplying the pressure champers with driving force allowing ink to be ejected through the nozzles connected to the pressure chambers and disposed on the pressure chambers having membranes interposed therebetween; dampers connecting the pressure chambers with the nozzles and having a pressure adjusting channel provided therebetween, the pressure adjusting channel adjusting a pressure of ink ejected through the nozzles; and an ink cartridge combined with the inkjet head and supplying ink to the inkjet head.

According to another aspect of the present invention, there is provided an inkjet head, the inkjet head including: an inkjet head plate having a plurality of nozzles ejecting ink provided therein; pressure chambers storing ink drawn in from both outer ends of the inkjet head plate in a width direction thereof and facing each other in a direction inwards of the width direction; piezoelectric elements supplying the pressure champers with driving force allowing ink to be ejected through the nozzles connected to the pressure chambers and disposed on the pressure chambers having membranes interposed therebetween; a pressure adjusting channel connecting the pressure chambers to adjust a pressure of ink ejected through the nozzles.

The nozzles may be arranged in rows between the pressure chambers in a length direction of the inkjet head plate.

The inkjet head may further include dampers connecting the pressure chambers with the nozzles.

The dampers may be extended from the pressure chambers and slantly disposed in a length direction of the inkjet head plate.

According to another aspect of the present invention, there is provided an inkjet head, the inkjet head including: an inkjet head plate having a plurality of nozzles ejecting ink provided therein; pressure chambers storing ink drawn in from both outer ends of the inkjet head plate in a width direction thereof and facing each other in a direction inwards of the width direction; piezoelectric elements supplying the pressure champers with driving force allowing ink to be ejected through the nozzles connected to the pressure chambers and disposed on the pressure chambers having membranes interposed therebetween; and dampers connecting the pressure chambers with the nozzles and having a pressure adjusting channel provided therebetween, the pressure adjusting channel adjusting a pressure of ink ejected through the nozzles.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
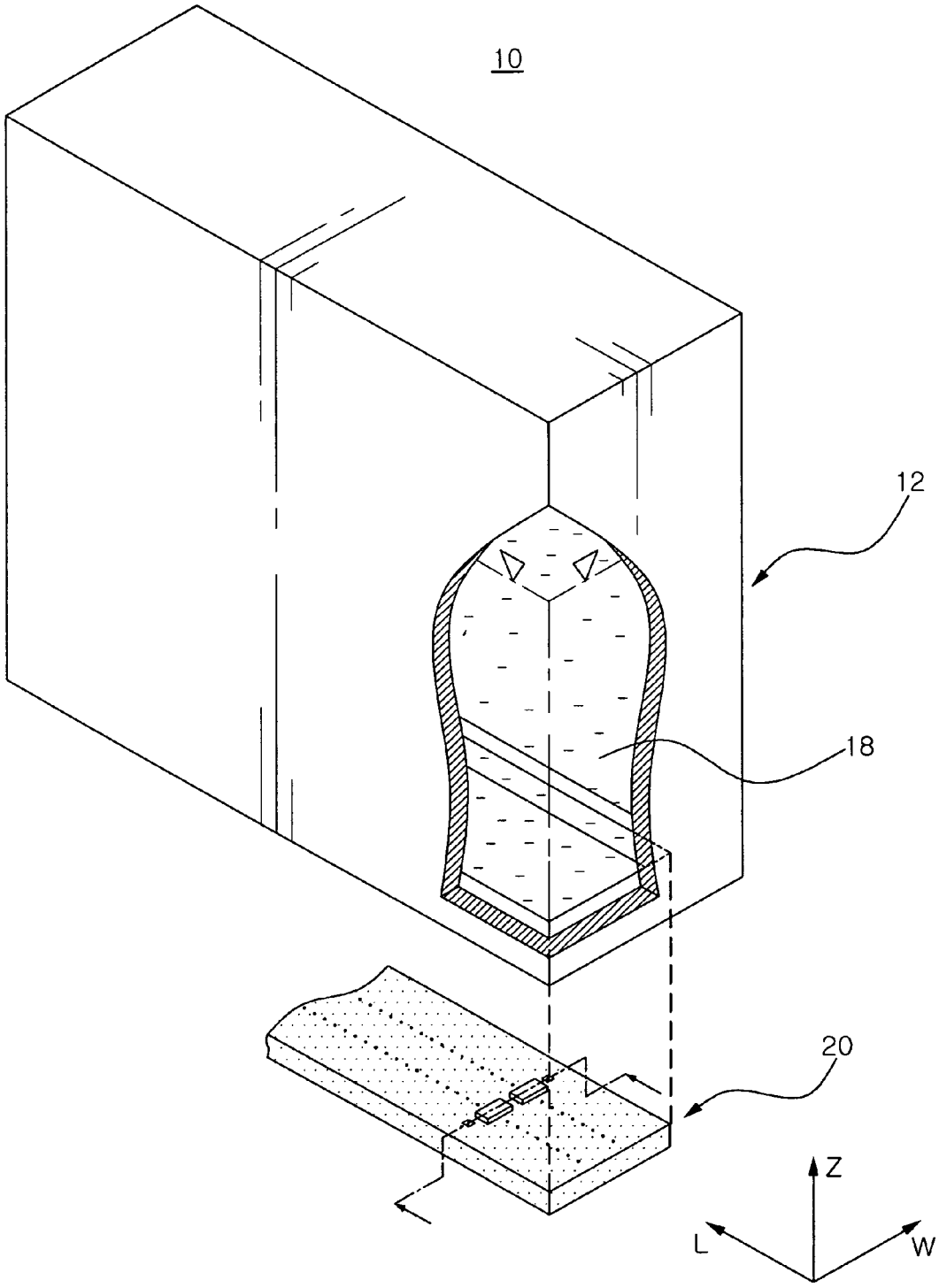
FIG. 1 is a perspective view illustrating an inkjet head assembly according to an exemplary embodiment of the present invention.

Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art.

Throughout the drawings, the same reference numerals will be used to refer to the same or like parts.

FIG. 1 is a perspective view illustrating an inkjet head assembly according to an exemplary embodiment of the present invention.

Referring to FIG. 1, an inkjet head assembly 10 according to an exemplary embodiment of the invention may include an inkjet head 20, structures included in the inkjet head 20, and an ink cartridge 12.

The inkjet head 20 may be accommodated on the lower surface of the ink cartridge 12 having a rectangular parallelepiped shape. The inkjet head 20 is a laminate of silicon plates allowing ink 18 in the ink cartridge 12 to be drawn into the inkjet head 20 and ejected onto an external printing medium.

The inkjet head 20 applied to the inkjet head assembly 10 may include all technical features of the inkjet head 20 according to exemplary embodiments of FIGS. 2 through 6 described below.

Figure 2:
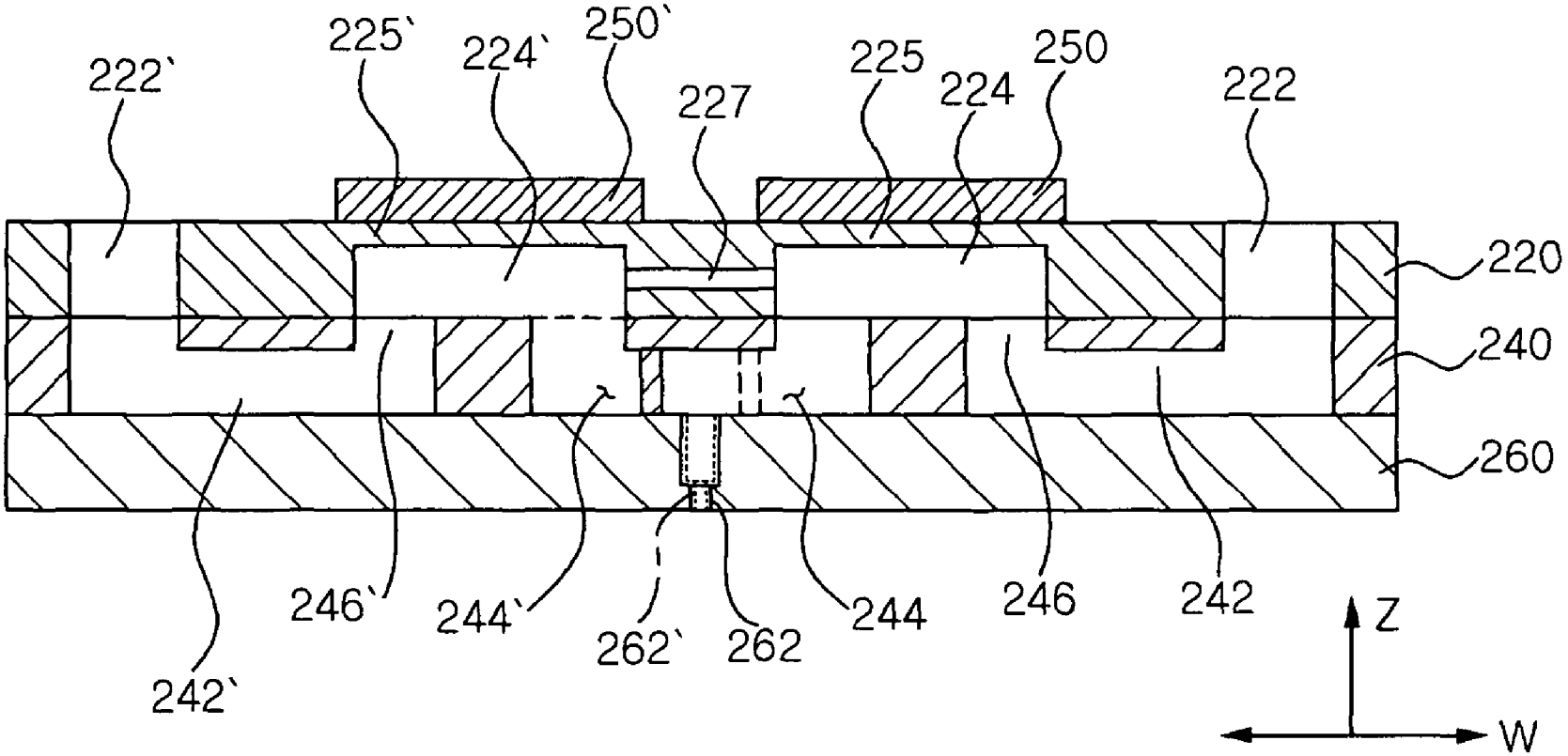
FIG. 2 is a cross-sectional view illustrating the stacked structure of an inkjet head according to an exemplary embodiment of the present invention.
Figure 3:
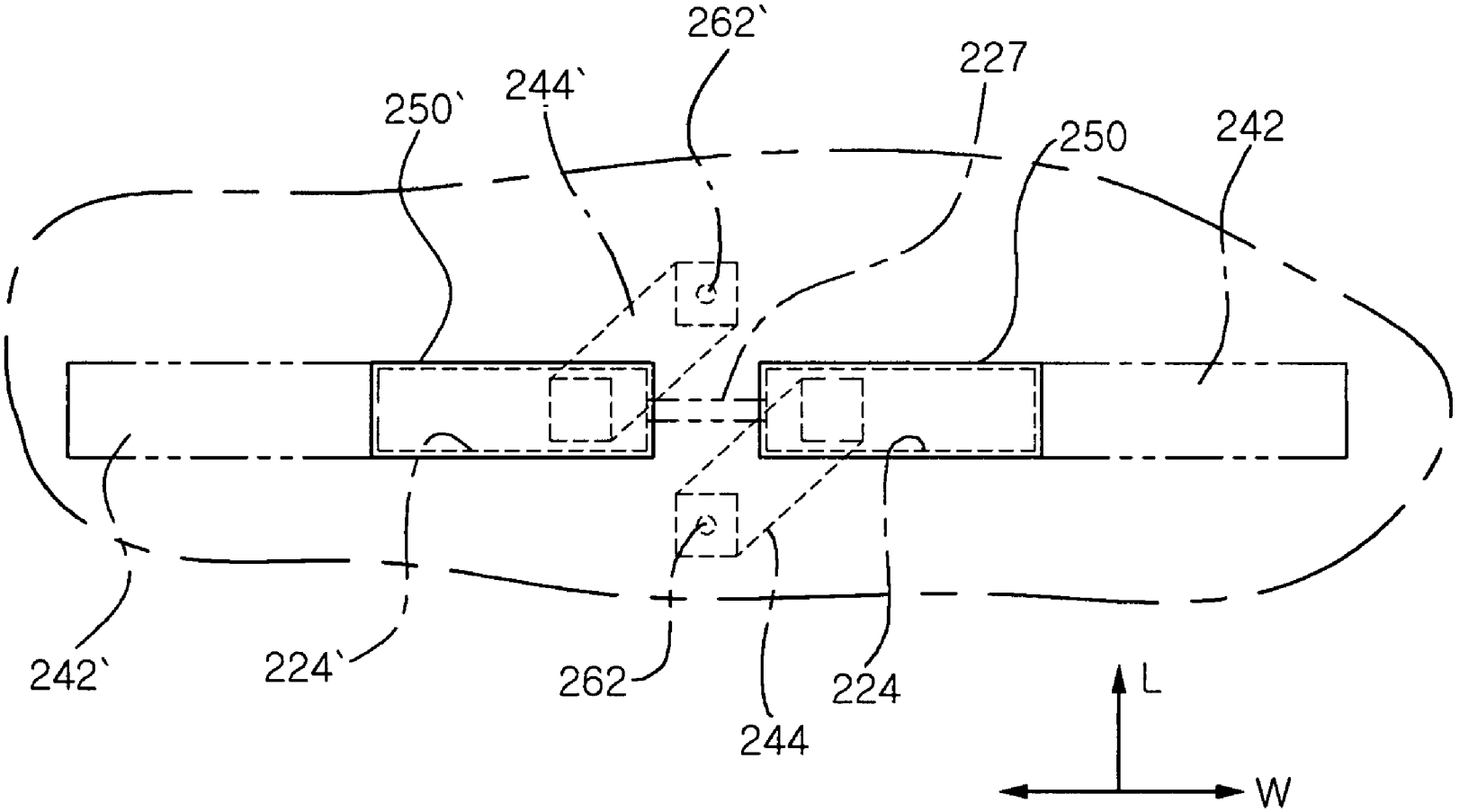
FIG. 3 is a schematic plan view illustrating the inkjet head of FIG. 2.

FIG. 2 is a cross-sectional view illustrating the stacked structure of an inkjet head according to an exemplary embodiment of the present invention. FIG. 3 is a schematic plan view illustrating the inkjet head of FIG. 2.

The inkjet head 20, as shown in FIG. 2, may be formed by stacking a plurality of substrates having holes formed therein. The holes constitute an ink path.

The inkjet head 20 includes an inkjet head plate formed by sequentially stacking a lower substrate 260, an intermediate substrate 240, and an upper substrate 220 in a direction towards the contact point between the ink cartridge 12 and the inkjet head 20 from the lower part of FIGS. 1 and 2.

Here, directions set forth herein are defined below. A stacked direction Z defines a direction stacked from the lower substrate 260 to the upper substrate 220. A width direction W defines a direction in which pressure chambers 224 and 224' are arranged from left to right inside the inkjet head 20. A length direction L defines a direction in which nozzles 262 and 262' are arranged in rows inside the inkjet head 20.

The upper substrate 220 has ink inlets 222 and 222' allowing ink to be drawn in from both outer ends of the inkjet head 20 in the width direction thereof and two rows of the pressure chambers 224 and 224' arranged to face each other in a direction inwards of the width direction.

On the top of two rows of the pressure chambers 224 and 224', piezoelectric elements 250 and 250' may be provided to have membranes 225 and 225' interposed therebetween. The piezoelectric elements 250 and 250' supply the pressure chambers 224 and 224' with driving force for ink ejection, respectively.

The piezoelectric elements 250 and 250' may allow ink ejection to be made by transforming the membranes 225 and 225' that are the upper surfaces of the pressure chambers 224 and 224'. A piezoelectric element may convert electrical energy into mechanical energy or vice versa, and its representative material is $Pb(Zr,Ti)O_3$. Also, for the ink ejection, a bubble jet or thermal jet method, besides a piezoelectric method using the piezoelectric elements 250 and 250', may be used.

The lower substrate 260 may have the nozzles 262 and 262' formed therein in such a manner that the nozzles 262 and 262' are arranged in rows in the length direction of the inkjet head 20.

The intermediate substrate 240 may have dampers 244 and 244' and reservoirs 242 and 242' formed therein. The reservoirs 242 and 242' store ink inside the inkjet head 20.

Also, the intermediate substrate 240 may have restrictors 246 and 246' formed therein in order to prevent the ink of the pressure chambers 224 and 224' from flowing backward into the reservoirs 242 and 242'.

Now, ink transfer is described with reference to one of the pressure chambers 224 and 224' facing each other. Ink is drawn from the ink inlet 222 disposed at an outermost end of the inkjet head 20 in the width direction thereof and transferred to the reservoir 242 storing ink and the restrictor 246 in a direction inwards of the width direction, and then transferred to the pressure chamber 224.

The ink accommodated in the pressure chamber 224 is transferred, by the driving force of the piezoelectric element 250, to the damper 244 formed in a direction inwards of the width direction and slantly disposed in the length direction, and then ejected to the outside through the nozzle 262.

Also, ink accommodated in the pressure chamber 224' facing the pressure chamber 224 is transferred in the same manner. Ink is drawn from the ink inlet 222' disposed at an outermost end of the inkjet head 20 in the width direction thereof and ejected to the outside through the nozzle 262' by being transferred in a direction inwards of the width direction.

Here, the pressure chambers 224 and 224' facing each other may have a tube-shaped pressure adjusting channel 227 formed therebetween. The pressure adjusting channel 227 may reduce pressure variations that may occur between the pressure chambers 224 and 224'. Also, the pressure adjusting channel 227 may remove variations in the size or speed of ink droplets ejected through the nozzles 262 and 262'.

Figure 4:
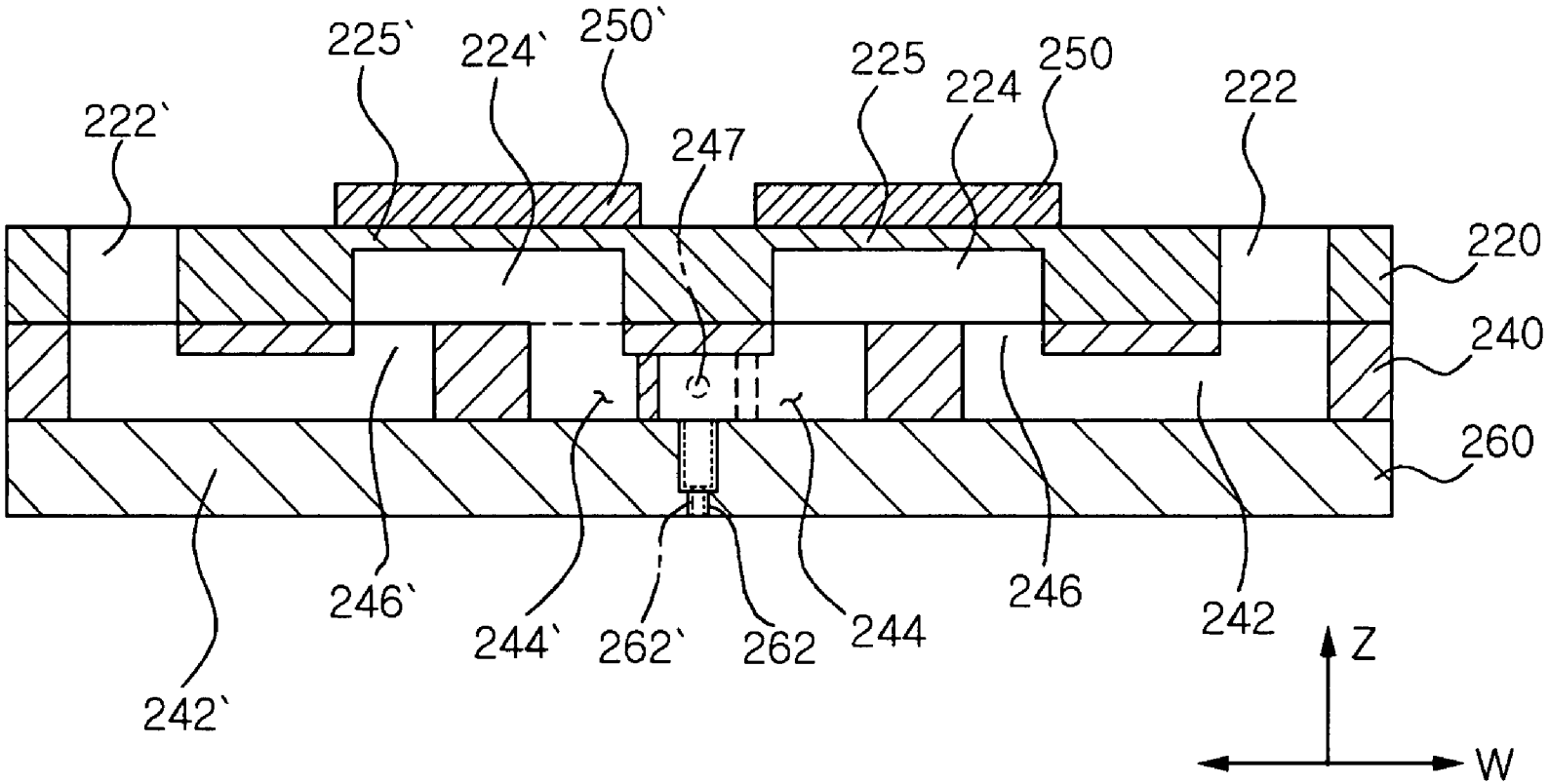
FIG. 4 is a cross-sectional view illustrating the stacked structure of an inkjet head according to another exemplary embodiment of the present invention.
Figure 5:
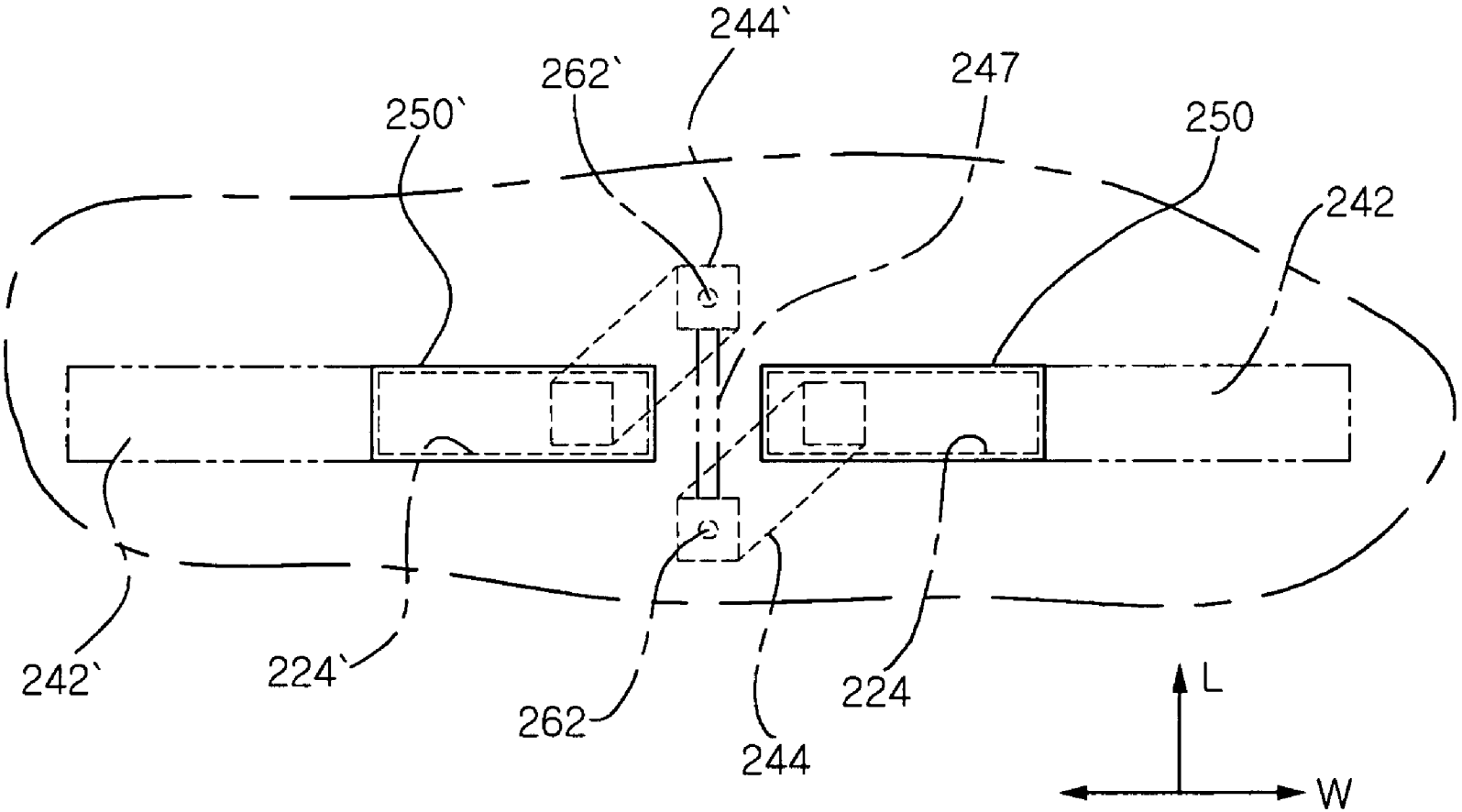
FIG. 5 is a schematic plan view illustrating the inkjet head of FIG. 4.

FIG. 4 is a cross-sectional view illustrating the stacked structure of an inkjet head according to another exemplary embodiment of the present invention. FIG. 5 is a schematic plan view illustrating the inkjet head of FIG. 4.

In contrast to the exemplary embodiments of FIGS. 2 and 3, the exemplary embodiments of FIGS. 4 and 5 have a configuration wherein a pressure adjusting channel 247 connects the damper 244 slantly disposed in the length direction with the damper 244' disposed to face the damper 244.

This pressure adjusting channel 247 connecting the dampers 244 and 244' may reduce variations in the pressure, size or speed of ink droplets ejected through the nozzles 262 and 262', like the pressure adjusting channel 227 in the exemplary embodiments of FIGS. 2 and 3.

The other elements are the same as those in the exemplary embodiments of FIGS. 2 and 3, so a detailed description thereof will be omitted.

Figure 6:
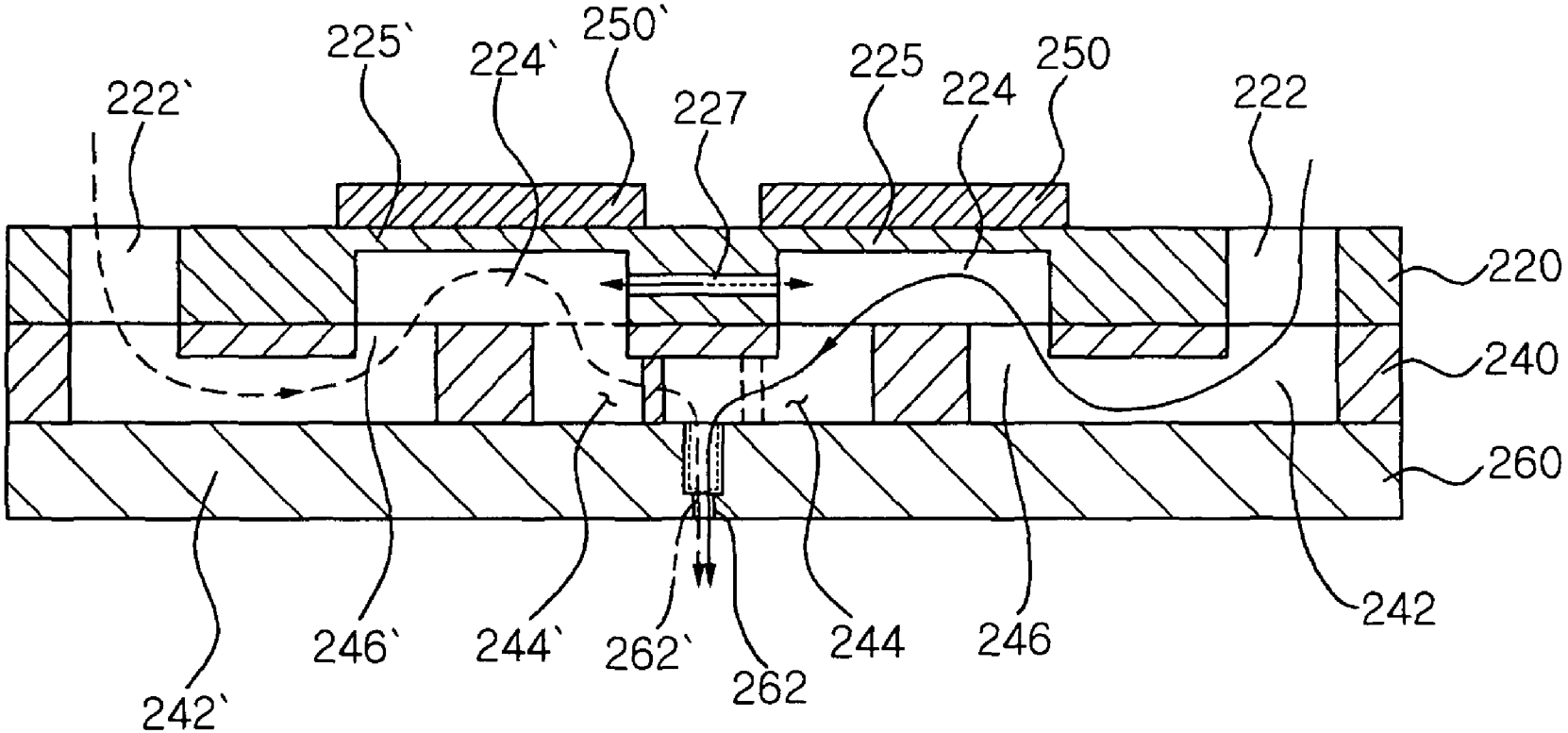
FIG. 6 is a cross-sectional view illustrating the transfer of ink ejected from the inkjet head of FIG. 2.

FIG. 6 is a cross-sectional view illustrating the transfer of ink ejected from the inkjet head of FIG. 2.

Referring to FIG. 6, solid and dotted lines express ink transfer inside the inkjet head 20.

Reviewing the ink transfer expressed by the solid line, ink is drawn from the ink inlet 222 disposed at an outermost end of the inkjet head 20 in the width direction thereof and transferred to the reservoir 242 storing ink and the restrictor 246 in a direction inwards of the width direction, and then transferred to the pressure chamber 224.

The ink accommodated in the pressure chamber 224 is transferred, by the driving force of the piezoelectric element 250, to the damper 244 formed in a direction inwards of the width direction and slantly disposed in the length direction, and then ejected to the outside through the nozzle 262.

Also, ink transfer in the pressure chamber 224' facing the pressure chamber 224, expressed by the dotted line, is performed in the same manner. Ink is drawn from the ink inlet 222' disposed at an outermost end of the inkjet head 20 in the width direction thereof and ejected to the outside through the nozzle 262' by being transferred in a direction inwards of the width direction.

Here, the ink inside the pressure chambers 224 and 224' facing each other is allowed to move therebetween through the pressure adjusting channel 227. The pressure adjusting channel 227 may adjust the pressures of the pressure chambers 224 and 224' to thereby reduce variations in the speed or size of ink droplets ejected through the nozzles 262 and 262' respectively connected with the pressure chambers 224 and 224'.

In the inkjet head and the inkjet head assembly having the same according to exemplary embodiments of the invention, while the inkjet head has the pressure chambers facing each other and the nozzles respectively connected to the pressure chambers, the pressure of ink droplets ejected through the nozzles may be uniformly adjusted by the pressure adjusting channel connecting the pressure chambers.

Also, such a uniform adjustment of the pressure of ink droplets ejected through the nozzles respectively connected to the pressure chambers may lead to a reduction in variations in the speed or size of ink droplets.

Moreover, since the ink ejection pressure of the nozzles is uniformly adjusted, high print quality may be achieved.

As set forth above, an inkjet head and an inkjet head assembly having the same according to exemplary embodiments of the invention, may allow for uniform pressure in ink ejected through nozzles by the use of a pressure adjusting channel connecting pressure chambers while the pressure chambers are arranged to face each other and the nozzles are respectively connected to the pressure chambers.

Also, the pressure in ink ejected through the nozzles respectively connected to the pressure chambers is uniformly adjusted to thereby reduce variations in the speed or size of ink droplets.

Furthermore, the ink ejection pressure of the nozzles is uniformly adjusted, and thus high print quality is achieved.

While the present invention has been shown and described in connection with the exemplary embodiments, it will be apparent to those skilled in the art that modifications and variations can be made without departing from the spirit and scope of the invention as defined by the appended claims.

What is claimed is:

1. An inkjet head assembly comprising:

an inkjet head having a plurality of nozzles ejecting ink provided therein;

pressure chambers storing ink drawn in from both outer ends of the inkjet head in a width direction thereof and facing each other in a direction inwards of the width direction;

piezoelectric elements supplying the pressure champers with driving force allowing ink to be ejected through the nozzles connected to the pressure chambers and disposed on the pressure chambers having membranes interposed therebetween;

a pressure adjusting channel connecting the pressure chambers to adjust a pressure of ink ejected through the nozzles; and an ink cartridge combined with the inkjet head and supplying ink to the inkjet head.

2. The inkjet head assembly of claim 1, wherein the nozzles are arranged in rows between the pressure chambers in a length direction of the inkjet head.

3. The inkjet head assembly of claim 1, further comprising dampers connecting the pressure chambers with the nozzles.

4. The inkjet head assembly of claim 3, wherein the dampers are extended from the pressure chambers and slantly disposed in a length direction of the inkjet head.

5. An inkjet head assembly comprising:

an inkjet head having a plurality of nozzles ejecting ink provided therein;

pressure chambers storing ink drawn in from both outer ends of the inkjet head in a width direction thereof and facing each other in a direction inwards of the width direction;

piezoelectric elements supplying the pressure champers with driving force allowing ink to be ejected through the nozzles connected to the pressure chambers and disposed on the pressure chambers having membranes interposed therebetween;

dampers connecting the pressure chambers with the nozzles and having a pressure adjusting channel provided therebetween, the pressure adjusting channel adjusting a pressure of ink ejected through the nozzles; and an ink cartridge combined with the inkjet head and supplying ink to the inkjet head.

6. An inkjet head comprising:

an inkjet head plate having a plurality of nozzles ejecting ink provided therein;

pressure chambers storing ink drawn in from both outer ends of the inkjet head plate in a width direction thereof and facing each other in a direction inwards of the width direction;

piezoelectric elements supplying the pressure champers with driving force allowing ink to be ejected through the nozzles connected to the pressure chambers and disposed on the pressure chambers having membranes interposed therebetween;

a pressure adjusting channel connecting the pressure chambers to adjust a pressure of ink ejected through the nozzles.

7. The inkjet head of claim 6, wherein the nozzles are arranged in rows between the pressure chambers in a length direction of the inkjet head plate.

8. The inkjet head of claim 6, further comprising dampers connecting the pressure chambers with the nozzles.

9. The inkjet head of claim 8, wherein the dampers are extended from the pressure chambers and slantly disposed in a length direction of the inkjet head plate.

10. An inkjet head comprising:

an inkjet head plate having a plurality of nozzles ejecting ink provided therein;

pressure chambers storing ink drawn in from both outer ends of the inkjet head plate in a width direction thereof and facing each other in a direction inwards of the width direction;

piezoelectric elements supplying the pressure champers with driving force allowing ink to be ejected through the nozzles connected to the pressure chambers and disposed on the pressure chambers having membranes interposed therebetween; and dampers connecting the pressure chambers with the nozzles and having a pressure adjusting channel provided therebetween, the pressure adjusting channel adjusting a pressure of ink ejected through the nozzles.

* * * * *